US005442161A

United States Patent [19]

Matsushima

[11] Patent Number: 5,442,161

[45] Date of Patent: Aug. 15, 1995

[54] OVEN HAVING VACUUM HEAT INSULATING WALL AND METHOD FOR ASSEMBLING SAME

[75] Inventor: Haruo Matsushima, Yamatokoriyama, Japan

[73] Assignee: Matsushita Electric Industrial Co., Ltd., Osaka, Japan

[21] Appl. No.: 128,192

[22] Filed: Sep. 29, 1993

[30] Foreign Application Priority Data

Sep. 30, 1992 [JP] Japan ..... 4-261176

[51] Int. Cl.[6] ..... H05B 6/76

[52] U.S. Cl. ..... 219/756; 219/685; 219/722; 219/738; 219/754; 219/746

[58] Field of Search ..... 219/756, 757, 739, 740, 219/722, 723, 724, 754, 685, 746, 738; 392/449, 450

[56] References Cited

U.S. PATENT DOCUMENTS 1,526,204 2/1925 Campbell ..... 392/449
3,576,417 4/1971 Tingley ..... 219/739
4,680,439 7/1987 Millman ..... 219/756
4,788,395 11/1988 Sakoda ..... 219/756
5,006,689 4/1991 Kurachi et al. ..... 392/450
5,293,020 3/1994 Han et al. ..... 219/724

FOREIGN PATENT DOCUMENTS 0110364 6/1984 European Pat. Off. .
61-11528 1/1986 Japan ..... 219/756
4-359888 12/1992 Japan ..... 219/756

*Primary Examiner*—Philip H. Leung
*Attorney, Agent, or Firm*—Wenderoth, Lind & Ponack

[57] ABSTRACT

A partitioning plate having a configuration which can be inserted into a double wall vacuum container from an opening of vacuum container divides the space of the vacuum container into two spaces. One of the spaces which serves as a heating chamber, is opened and closed by a door. The other space, which serves as a mechanical chamber, accommodates electrical parts. A method for fixing the partitioning plate, on which parts have been installed, to the double vacuum container is faciliated by the provision of a device for regulating the position of the partitioning plate.

24 Claims, 7 Drawing Sheets

OVEN HAVING VACUUM HEAT INSULATING WALL AND METHOD FOR ASSEMBLING SAME

BACKGROUND OF THE INVENTION

1. Field of the Invention

The present invention relates to a heating device such as an oven which has a greatly improved heat efficiency and a high volumetric ratio in a heating chamber and can be assembled at a high efficiency, 2. Description of the Related Arts An oven having a self-cleaning function has a heat insulating material having a thickness of 40 to 70 mm formed in the periphery of a heating chamber and thus has a preferable heat insulating performance. An oven having a function of heating food by high-frequency wave depends on forced air-cooling performed by a fan motor because a high-frequency wave-generating device such as a magnetron is incapable of effecting a preferable heat insulation. As a result, the oven has a low heat efficiency and thus, there is a growing demand for the development of an oven having an improved heat efficiency. Even an oven not having the function of heating food by high-frequency wave, volumetric ratio, namely, the ratio of the volume of the heating chamber to the volume of the entire oven is small because a thick heat insulating material is used in the oven. If an oven is designed so that the oven can be accommodated in a cabinet of European size, the width of the heating chamber is 18 inches at most. Thus, it is impossible to manufacture an oven in which the width of the heating chamber is 19 inches. In recent years, a countertop type microwave oven provided with an electric heater has been widely used. But in this type of oven, there is a limitation to the heat insulating construction and thus the oven has a low heat efficiency. Therefore, the improvement of the heat insulating construction is demanded regardless of whether or not an oven has the function of heating food by microwave.

Researches has been carried out with regard to the manufacturing of an oven (not provided with an electric heater) at a low cost and at a high efficiency. Examples of conventional ovens including an oven disclosed in European Patent No. 0110364 are described below. In a microwave oven shown in FIG. 9, a heating chamber 43 and an outer casing 92 are separately constructed, whereas in a microwave oven shown in FIG. 10, walls of the heating chamber 43 serve as an outer casing, and a mechanical chamber 63 is disposed alongside of the heating chamber 43. The oven shown in FIG. 10 is simple in its construction in that walls of the heating chamber 43 serve as the outer casing, i.e., no double construction (wall) is provided, but the operation for installing various electrical parts in the small mechanical chamber 63 is less efficient than the operation required for installing them in the mechanical chamber of the oven shown in FIG. 9 or in mechanical chambers of other conventional ovens. That is, the oven of FIG. 10 is not superior to conventional ovens in productivity. There is a strong and growing demand for microwave ovens which can be manufactured at a high efficiency now that microwave ovens are necessities of life and thus several millions of ovens have been manufactured in the world.

SUMMARY OF THE INVENTION

It is an object of the present invention to provide a microwave oven having an improved heat insulating performance, heat efficiency, and volumetric ratio in a heating chamber thereof.

It is another object of the present invention to provide a microwave oven which can be manufactured at a high efficiency by providing a construction in which walls of a heating chamber serve as an outer casing.

In accomplishing these and other objects, there is provided an oven having a function of heating food by high-frequency wave comprising: a double walled vacuum container made of metal; a metal partitioning plate dividing a space of the container into two spaces; a door; a first heating source consisting of a heater; a second heating source consisting of a magnetron; and electrical parts including a controller. The opening of one of the spaces serving as a heating chamber is closed by the door. The other space serving as a mechanical chamber accommodates the electrical parts. According to this construction, the walls of the heating chamber are surrounded with the double-walled metal container except for the two walls constituted by the partitioning plate and the door. The double walled vacuum container made of metal is widely used as a vacuum bottle which is known for its preferable heat insulating performance. Thus, the heating chamber has an excellent heat insulating performance except for the walls constituted by the partitioning plate and the door. Therefore, the oven has a high heat efficiency and the heating chamber has a great volumetric ratio.

There is also provided a microwave oven comprising: a metal container; a metal partitioning plate dividing a space of the container into two spaces; a door; a heating source consisting of a magnetron; and electrical parts including a controller.

One of the spaces accommodates the electrical parts. The opening of the other space serves as a heating chamber and is opened and closed by the door. Means for preventing the leakage of radio waves is provided at a portion of the partitioning plate which confronts the container and an end of the door.

According to this construction, the walls of the container serve as the walls of the heating chamber and the outer casing of the microwave oven. In addition, in installing the electrical parts in the container, they are mounted on the partitioning plate which is then inserted into the container. Therefore, the electrical parts can be fixed to the mechanical chamber with ease and efficiency. Further, the means for preventing the leakage of radio waves prevents radio waves from being leaked from the heating chamber to the mechanical chamber.

There is also provided an oven comprising: a double wall vacuum container made of metal; a metal partitioning plate having a configuration dividing a space of the container into two spaces; a door; a heating source consisting of a heater; and electrical parts including a controller. One of the spaces accommodates the electrical parts; and an opening of the other space serves as a heating chamber is closed by the door, the door being pivotally mounted.

According to this construction, the walls of the heating chamber are surrounded with the double wall metal container of except for the two walls constituted by the partitioning plate and the door. A double wall vacuum container made of metal is widely used as a vacuum bottle which is known for its preferable heat insulating performance. Thus, the heating chamber has an excellent heat insulating performance, except for the walls constituted by the partitioning plate and the door.

Therefore, the oven has a high heat efficiency and the heating chamber has a great volumetric ratio.

There is provided a method, for assembling a heating apparatus such as an oven which carried out by mounting to a metal container: a metal partitioning plate having a configuration which can be inserted into the container from an opening thereof and which divides a space of the container into two spaces; a door; a heating source consisting of a heater or a magnetron; electrical parts including a controller; and means for regulating the position of the partitioning plate. In this method, the heating source and the electrical parts are installed on the partitioning plate, and then, the partitioning plate is inserted into the container and fixed thereto.

According to this method, the electrical parts can be installed on the partitioning plate downward, forward, backward or laterally. Further, the partitioning plate is inserted into the container and fixed thereto with the heating source and the electrical parts mounted thereon. Therefore, these parts can be installed on the container with ease and efficiency.

BRIEF DESCRIPTION OF THE DRAWINGS

These and other objects and features of the present invention will become clear from the following description taken in conjunction with the preferred embodiments thereof with reference to the accompanying drawings.

DETAILED DESCRIPTION OF THE INVENTION

Figure 1:
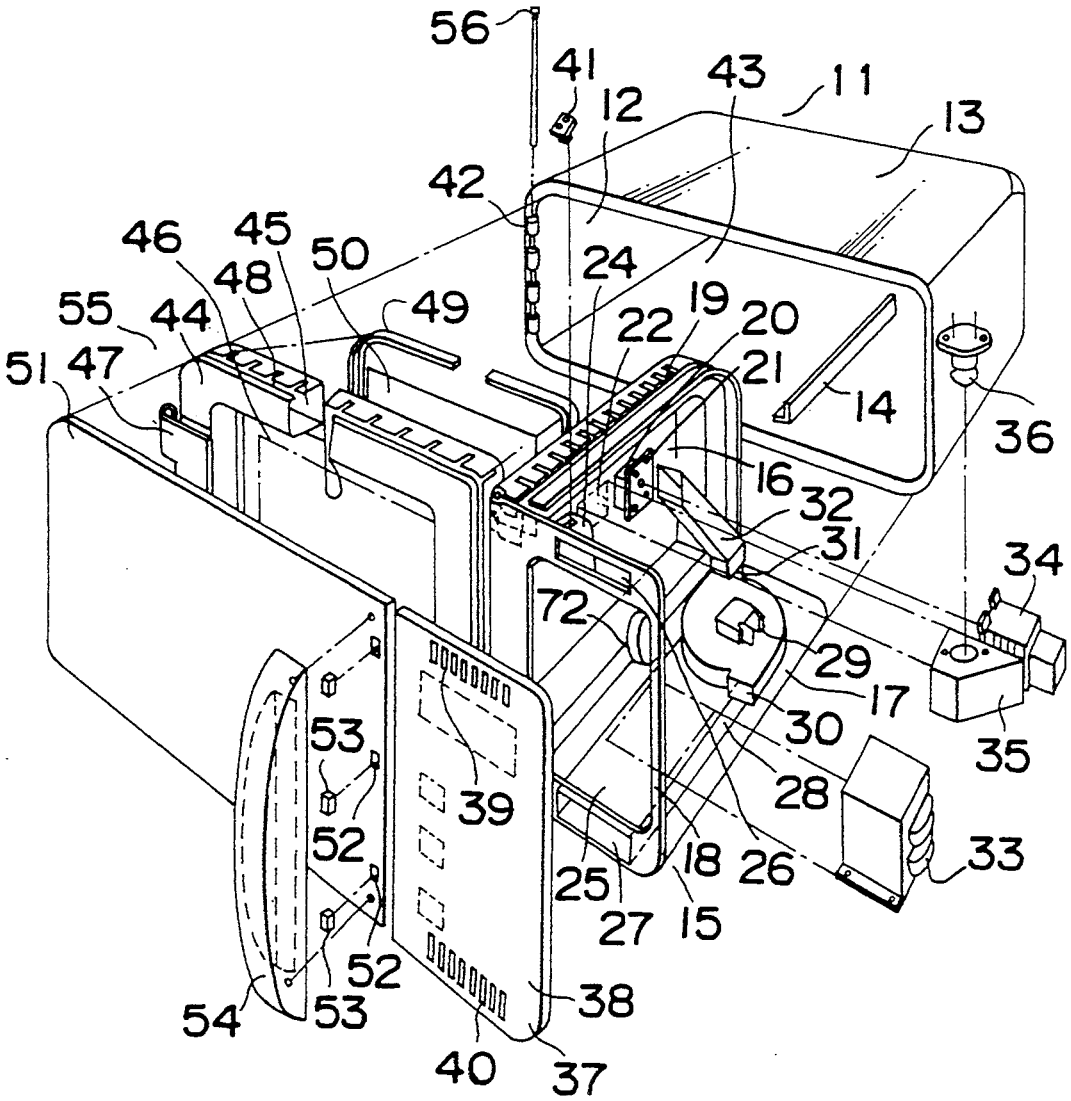
FIG. 1 is an exploded perspective view showing an oven having a function of heating food by high-frequency wave according to an embodiment of the present invention.

Before the description of the present invention proceeds, it is to be noted that like parts are designated by like reference numerals throughout the accompanying drawings.

An oven having a vacuum heat insulating wall according to an embodiment of the present invention is described below with reference to the accompanying drawings. FIG. 1 is an exploded perspective view showing an embodiment of the present invention. An approximately rectangular solid container 11 made of metal comprises an inner casing 12 and an outer casing 13. A narrow space 11*a* (see FIG. 11) formed between the inner casing 12 and the outer casing 13 is closed. The interior of the container 11 is kept at a sufficient low pressure, namely, at a certain degree of vacuum. That is, the container 11 is constructed like a commercially available vacuum bottle made of stainless steel, and the size of the opening portion of the container 11 is approximately the same as that of the interior thereof. L-shaped fittings 14 can be fixed to the bottom and upper surfaces of the inner casing 12 (see FIG. 4). FIG. 1 shows a case in which the fitting 14 is fixed not to the upper surface of the inner casing 12 but to the bottom surface thereof. An assembled unit 15 is fixed to the fitting 14 by means of screws, with the unit 15 inserted into the inner casing 12 at the right side of the fitting 14. The unit 15 comprises a metal plate and electrical parts which will be described later. The metal plate is composed of a partitioning plate 16 having a size and configuration which contacts the bottom surface, rear surface, and upper surface of the inner casing 12; a bottom plate 17 which is perpendicular to the partitioning plate 16 and contacts the bottom surface of the inner casing 12; a front plate 18 having a surface perpendicular to the partitioning plate 16 as well as the bottom plate 17. The electrical parts are installed on the metal plate. A slit type choke serving as a mechanism for preventing the leakage of radio waves is provided on the upper, rear, and lower ends of the partitioning plate 16, namely, portions of the partitioning plate 16 confronting the upper, rear, and bottom surfaces of the inner casing 12.

A wave guide 20 and a magnetron-installing plate 21 are provided on an upper rear portion of the partitioning plate 16. A plurality of small openings 22 are disposed at positions a little forward of the wave guide 20 and the magnetron-installing plate 21. The openings 22 serve as a means for supplying cooling air to a heating chamber. There are provided, a little forward of the openings 22, a plurality of small discharge openings 23 (not shown in FIG. 1 but in FIG. 3C) used to discharge air and a discharge passage 24 surrounding the discharge openings 23. A motor 72 for driving a turntable which will be described later is installed on the partitioning plate 16 at a lower center thereof.

The front plate 18 is a one-piece metal plate in which three large openings are formed. The three openings are: a rectangular opening 25 large in the width and length thereof; a discharge opening 26, large in width, formed above the rectangular opening 25; and a suction opening 27, large in width, formed below the rectangular opening 25. The discharge passage 24 communicates with the left half of the suction opening 26 and the discharge openings 23 formed on the partitioning plate 16.

The bottom plate 17 has a double wall construction. A suction passage 28 having a size equal to the suction opening 27 formed on the front plate 18 extends rearward from the front plate 18. A fan motor 29 is disposed in the vicinity of the termination of the suction passage 28. The suction opening (not shown) of the fan motor 29 communicates with the suction passage 28. The fan motor 29 has a discharge opening 30 for discharging air forwardly and a discharge opening 31 for discharging air upwardly. The discharge opening 31 is connected with an air introducing passage 32. A high voltage transformer 33 is disposed above the suction passage 28 and forward of the discharge opening 30.

A magnetron 34 is installed on a magnetron-installing plate 21 in such a manner that an antenna of the magnetron 34 is disposed in the wave guide 20. A second air-introducing passage 35 is installed on the magnetron-installing plate 21 in such a manner that second air-introducing passage 35 communicates with a cooling air discharge portion of the magnetron 34 and the openings 22. A circular opening is formed on the upper surface of the second air-introducing passage 35. An illuminating lamp 36 is inserted into the circular opening and fixed thereto.

An operation section 37 is installed on the front plate 18. The operation section 37 is almost equal to the front plate 18 in size, but smaller than the front plate 18 horizontally by approximately 10 mm at the left side thereof in FIG. 1. The operation section 37 comprises a membrane switch 38 disposed on a surface thereof and an electronic circuit (not shown) installed at the rear of the membrane switch 38. The operation section 37 has a plurality of discharge slits 39 at positions corresponding to the discharge opening 26 and a plurality of suction slits 40 at positions corresponding to the suction opening 27.

A rectangular opening is formed on the upper surface of the discharge passage 24, and a thermistor 41 is inserted into the rectangular opening and fixed thereto. After the unit 15 to be installed in a mechanical chamber is constructed as described above, the unit 15 is inserted at the right side of the fitting 14 disposed inside the inner casing 12. The front plate 18 on which the operation section 37 has been installed closes the right side of the front opening of the container 11.

A hinge fitting 42 is installed on the left side of the opening of the container 11. A space 43 disposed on the left of the fitting 14 inside the inner casing 12 is hereinafter referred to as a heating chamber. A slit type choke serving as a mechanism for preventing the leakage of radio waves is provided on the entire periphery of a door 44 which is a little smaller than the opening of the space 43. A plurality of transparent small openings 46 is formed in the center portion of the door 44 within a region surrounded by a one-dot chain line of FIG. 1. A second hinge fitting 47 engaging the hinge fitting 42 is mounted on the door 44 at the left side thereof. A glass plate 50 which is a little larger than the region where the openings 46 are formed is adhered to the back surface of the door 44, thus closing each of the openings 46.

A transparent plate 51 made of transparent resin such as polycarbonate is adhered to the front surface of the door 44. The transparent plate 51 is as large as the door 44 but larger than the door 44 horizontally by approximately 10 mm to right side thereof. Three rectangular grooves 52 are formed on the right region (region of 10 mm) of the transparent plate 51 so that three multipolar ferrite magnets 53 in a rectangular solid configuration are accommodated in the rectangular grooves 52, respectively. A grip 54 for covering the ferrite magnets 53 is fixed to the transparent plate 51.

In a unit 55 of the door 44 comprising the above-described parts thus assembled, the second hinge fitting 47 is engaged by the hinge fitting 42 fixed to the left end of the container 11, and a hinge pin 56 is inserted downward into the hinge fitting 42 to couple the hinge fitting 42 and the hinge fitting 47 with each other.

In this state, the door unit 55 closes the opening of the heating chamber 43 and the right side (of approximately 10 mm) of the transparent plate 51 is brought into contact with the front plate 18 of the unit 15. As a result, the door unit 55 can be prevented from pivoting into the heating chamber 43.

Figure 2:
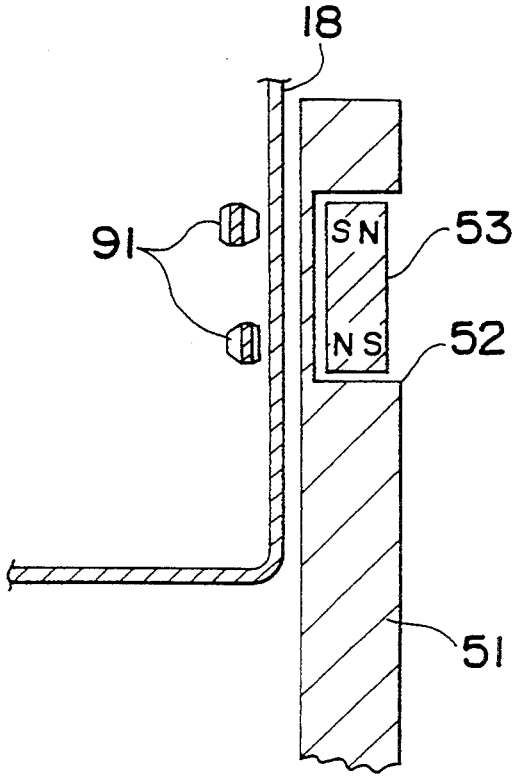
FIG. 2 is a horizontal sectional view showing a portion in which a transparent plate confronts a magnet.

FIG. 2 is a horizontal sectional view showing a portion in which the transparent plate 51 confronts the magnets 53 mounted on the front plate 18. The front plate 18 is composed of a material not attracted by a magnet, eg. austenitic stainless steel. Hall elements 91 are formed on the inner side of the front plate 18 in a direction corresponding to the polarity of the magnet 53. The Hall elements 91 are fixed to a printed circuit board, not shown. The Hall elements 91 are connected to the electronic circuit and are responsive to the magnetic pole of the magnet 53, thus inputting signals to the electronic circuit when the door unit 55 is closed.

Figure 3B:
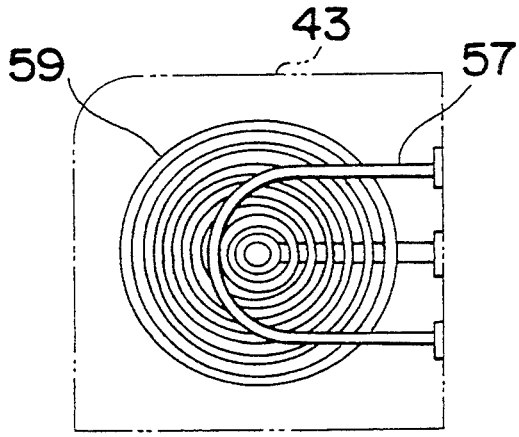
FIG. 3A, 3B and 3C are front, plan, and side elevational views, respectively showing a heating chamber of the oven having a function of heating food by high-frequency wave according to an embodiment of the present invention.
Figure 3C:
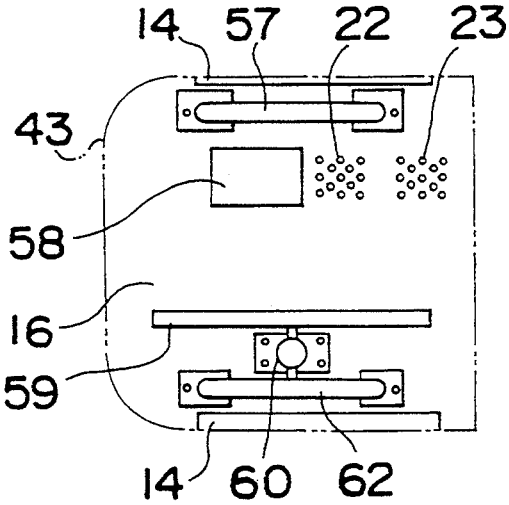
Figure 3A:
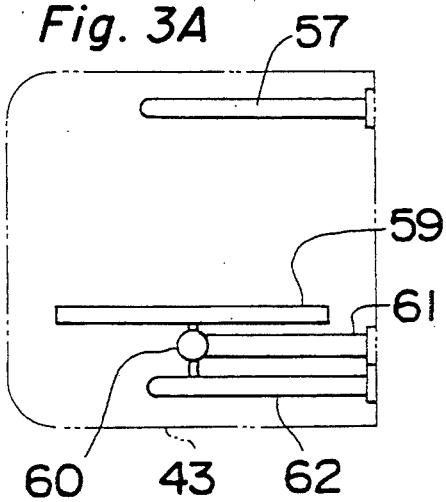

FIGS. 3A, 3B and 3C are plan, front, and side views, respectively showing the interior of the heating chamber 43. The heating chamber 43 is shown by a two-dot chain line in each view.

An upper heater 57 which is a U-shaped sheath heater is fixed in the heating chamber 43 in and extends through the partitioning plate 16. For the sake of simplicity, the leading end of the upper heater 57 is not shown in FIG. 1. An opening 58 of the wave guide 20, the openings 22, and the discharge openings 23 are arranged side by side below the upper heater 57. The opening 58 of the wave guide 20 is closed by a plate of crystallized glass.

A turntable 59 is disposed below these component parts. A gear box 60 is provided in the center of the turn table 59. A pipe 61 is provided between the gear box 60 and the partitioning plate 16. The pipe 61 is fixed to the partitioning plate 16 at a right angle therewith. A lower heater 62 is provided below the turntable 59. The lower heater 62 is similar to the upper heater 57 in its configuration and is fixed to the partitioning plate 16 in a similar manner.

Figure 4:
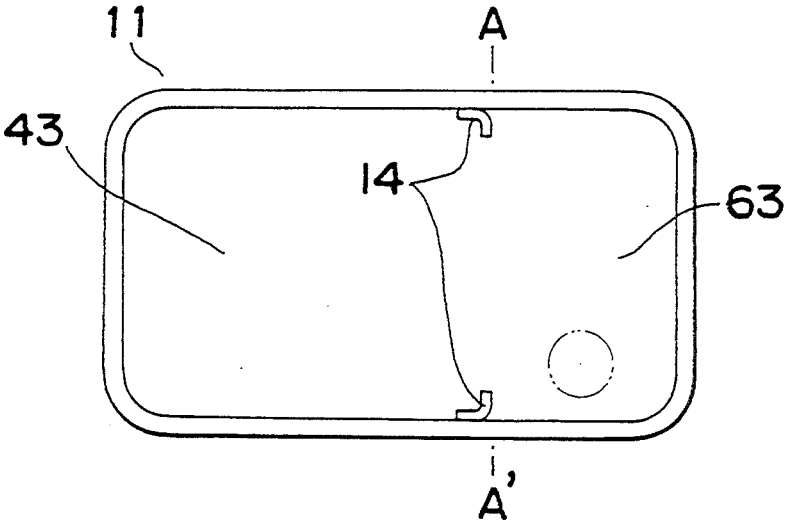
FIG. 4 is a front view showing the inner casing with L-shaped fittings.

FIG. 4 is a front view of the container 11. The hinge fitting 42 is not shown in FIG. 4. The space on the left side of a line A–A′ of FIG. 4 extending between the fittings 14 installed on the upper and lower surfaces of the inner casing 12 is denoted as the heating chamber 43 and the space on the right side of the line A–A′ is denoted as a space (mechanical chamber) 63 for accommodating various component parts.

Figure 5:
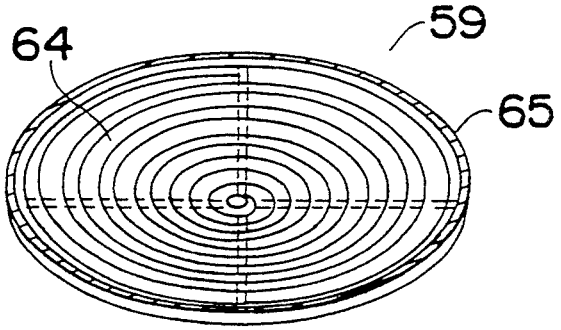
FIG. 5 is a perspective view showing a turntable according to an embodiment of the present invention.
Figure 6:
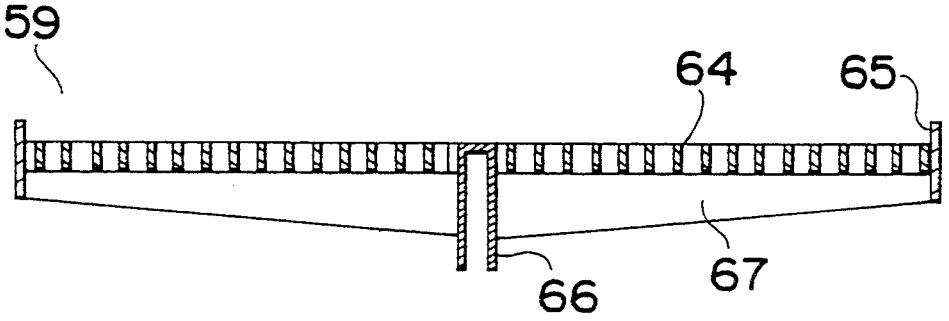
FIG. 6 is a sectional view showing the turntable of FIG. 5.
Figure 7:
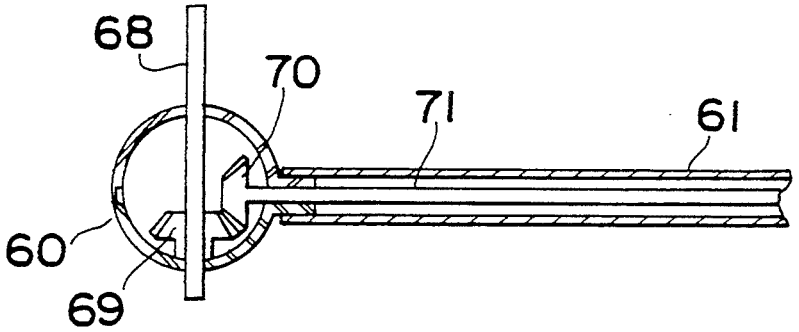
FIG. 7 is a sectional view showing a gear box according to an embodiment of the present invention.

FIG. 5 is a perspective view showing the turntable 59. FIG. 6 is a sectional view, showing the turntable 59, taken along a line passing through the center thereof. FIG. 7 is a sectional view showing the gear box 60 and the pipe 61. The turntable 59 comprises a spiral portion 64 made of stainless steel; a metal ring 65 disposed at the periphery thereof; a pipe-shaped bearing portion 66 extending downward from the center thereof; a supporting portion 67, made of ceramic, adhered to the metal ring 65 and the bearing portion 66. The ring 65 and the bearing portion 66 are formed by fixing a stainless steel plate and a pipe, respectively to the spiral portion 64 by spot welding. The spiral portion 64 and the supporting portion 67 are adhered to each other. It is important that the spiral portion 64 is uniform in its thickness.

The gear box 60 comprises a short pipe extending through a hollow sphere comprising upper and lower hemispheres shaped by aluminum die casting. An opening is formed in the center of each hemisphere and a shaft 68, made of alumina ceramic, is penetrated through each opening. A gear 69 in which a tooth surface is inclined by 45° is fixed to a lower portion of the shaft 68. The gear box 60 accommodates a second gear 70 engaging the gear 69 and a driving shaft 71 fixed to the second gear 70. The pipe 61 is fixed to a pipe-shaped portion of the gear box 60 at a side surface thereof by means of press fitting. Needless to say, the driving shaft 71 is coupled with the output shaft of a motor 72 for driving the turntable 59. The bearing portion 66 of the turntable 59 is connected (by insertion) to the shaft 68 to transmit the rotation of the motor 72 to the turntable 59.

Lead wires are not shown in FIG. 1 for the sake of simplicity. A power cord is described below. Because no openings are formed on the container 11 except the front opening, it is necessary to extend the power cord from the front thereof, namely, from a portion below the operation section 37. This construction is not a requirement of the present invention because it is not impossible to form a small opening for keeping the space between the inner casing and the outer casing vacuum at a position shown by a circle of two-dot chain line in FIG. 4 and extend the power cord to the outside from this opening. But the inclusion of such an opening is not reliable in maintaining vacuum because when the temperature of the air inside the heating chamber becomes high, i.e., when the temperature in the inner casing becomes much different from that in the outer casing, stress is applied to the metal of the container 11 and as a result, it is likely that fatigue is generated in the metal. In addition, it is expensive to form the opening because a complicated operation is required to install lead wires by using the opening.

An oven having the function of heating food by microwave can be accommodated in a vacuum container having two walls made of stainless steel and having a superb heat insulating performance. That is, the internal space of the inner casing 12 is divided into two regions (spaces) by the partitioning plate 16. The upper heater 57 and the lower heater 62 are installed in the space disposed at the left of FIG. 1, and the turntable 59 is mounted between the upper and lower heaters 57 and 62. Via the wave guide 20, the space is supplied with electric power of high-frequency waves generated by the magnetron 34, thereby heating food.

The opening of the space is closed by the door unit 55 pivotally installed on the container 11 by means of the hinge fittings 42 and 47 and the hinge pin 56. The high-frequency waves in the space can be prevented from leaking from the space by the slit type chokes disposed on the entire periphery of the door 44 and the upper end, rear end, and lower end of the partitioning plate 16. Accordingly, the space is capable of operating as the heating chamber of a microwave oven.

The other space (mechanical chamber) disposed at the right of the inner casing 12 accommodates the magnetron 34, the high-voltage transformer 33, electrical parts such as the motor 72 for driving the turntable 59, the fan motor 29, the operation section 37, and the electronic circuit (not shown). The high-frequency electric power required in the heating chamber 43, the electric power generated by the upper and lower heaters 57 and 62, and the force for driving the turntable 59 are provided to the heating chamber 43 through the partitioning plate 16. The mechanical chamber 63 is cooled by the fan motor 29 as follows: The fan motor 29 is rotated to draw in outside air via the slits 40. A part of the draw in air is transported to the high-voltage transformer 33 through the discharge opening 30, thus cooling the discharge opening 30 and being discharged to the outside via the right half of the discharge opening 26 and the slits 39. The remaining air passes through the discharge opening 31 and the air introducing passage 32, thus cooling the magnetron 34. Then, the remaining air passes through the second air introducing passage 35 and the openings 22, and is introduced into the heating chamber 43, and then, passes through the openings 23, the discharge passage 24, and the left half of the discharge opening 26 and is discharged to the outside together with vapor generated by food.

The above description is concerned with the operation of the electronic oven functioning to heat food by microwave. When the electronic oven is used to heat food without using microwaves, the fan motor 29 is not rotated. The air in the heating chamber 43 is expanded due to heating and thus a part of the air is discharged to the outside via the openings 23, the discharge passage 24, the discharge opening 26, and the slits 39. Because the thermistor 41 is disposed in the discharge passage 24, the thermistor 41 is sensitive to the temperature of the heated air. The heat inside the heating chamber 43 is transmitted to the mechanical chamber 63 via the partitioning plate 16, thereby increasing the temperature of the air inside the mechanical chamber 63. Owing to the expansion of the air caused by the temperature rise, a part of the air is discharged to the outside via the right half of the discharge opening 26 and the slits 39. Due to a chimney effect, air flows into the mechanical chamber from the slits 40. As a result, the mechanical chamber 63 is cooled in a small degree by a small amount of air which has been introduced thereinto.

Because the heating chamber 43 is approximately a rectangular solid, it has six surfaces. Of the six surfaces, four surfaces, namely, the upper, lower, left, and rear surfaces thereof compose the inner casing 12, thereby greatly preventing heat from being released therefrom. The remaining two surfaces, namely, the right surface of the heating chamber 63 and the front surface thereof are composed of the partitioning plate 16 and the door unit 55, respectively, and the rate of heat release from these two surfaces is not different from that of the conventional oven. But as a whole, the rate of heat release from the heating chamber 43 is much smaller than that of the conventional oven. In particular, the heating chamber 43 provides the effect of greatly reducing the amount of heat discharged from the upper surface (of the heating chamber 43), adjacent to the upper heater 57, which becomes highest in temperature in the heating chamber 43. In this manner, heat can be prevented to a great extent from being discharged from the heating chamber 43. That is, the oven has an improved heat efficiency. Therefore, a smaller quantity of electric power is required to bake food, for example, bread. In addition, a slight quantity of heat is transmitted through the outer casing 13 and thus the outer casing 13 has a low temperature. Accordingly, an operator is not likely to have his hand burnt, and the oven can be used in contact with wooden furniture. Further, the oven can be accommodated in a cabinet made of wood without providing a gap therebetween. As well known to those skilled in the art, there is a standard in each country that the temperature of the portion of the oven which is brought into contact with a wooden cabinet must be less than 100° C. Therefore, the temperature of the outer casing of the oven should be lower than 100° C.

The turntable 59 is described below. The turntable 59 is composed of rectangular elements which are arranged in parallel with each other at regular intervals and with the longer sides thereof vertical. The interval between adjacent elements is small (for example, approximately 1 cm) and the upper surfaces of the elements are flush with each other. This construction allows high-frequency waves to pass above and below the turntable 59 without loss when the oven is used to heat food by high-frequency wave. The wavelength of high-frequency wave widely used to heat food is approximately 12 cm. According to the theory of a wave guide, radio wave can be transmitted without loss irrespective of the height of a wave guide when the width of the wave guide is half as large as the wavelength of the high-frequency waves widely used to heat food, i.e., when the width of the wave guide is 6 cm. If the turntable 59 is of a spiral configuration, the distance between adjacent elements corresponds to the height of the wave guide, and the width of the wave guide is the distance between the center of the spiral and the periphery thereof. Therefore, the width of the wave guide is more than 6 cm. In addition, since air flows freely above and below the spiral surface, heated air flows freely when the oven is used to heat food without using high-frequency waves. Accordingly, the turntable 59 can be used both in the microwave oven mode and the oven mode.

The reason each element is rectangular and the longer sides thereof are vertically disposed is to make the turntable 59 light in order to present a low heat capacity thereof, strengthen it, and improve the area of the opening to accomplish a favorable flow of heated air.

Figure 8:
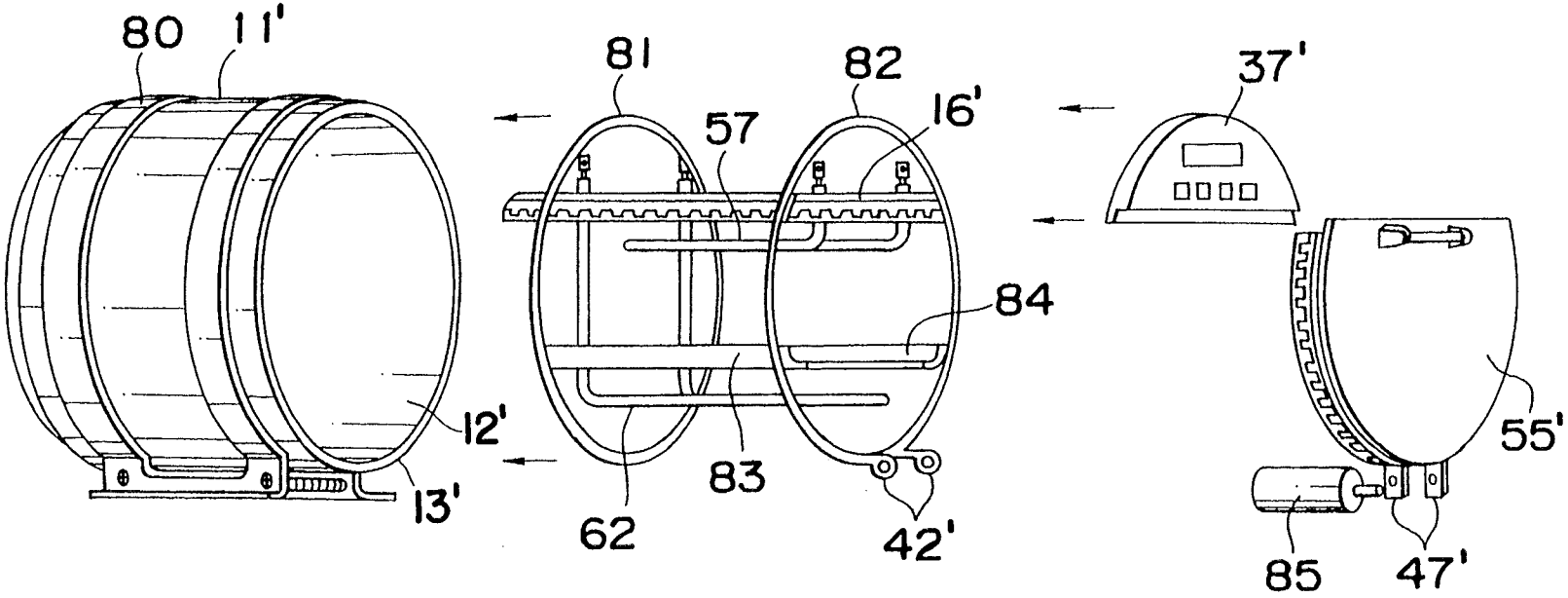
FIG. 8 is an exploded perspective view showing an oven having a function of heating food by high-frequency wave according to another embodiment of the present invention.

FIG. 8 is an exploded perspective view showing an oven according to another embodiment of the present invention. The container 11' is cylindrical. A Ω-shaped metal band 80 is wound around the peripheral surface of an outer casing 13'. A unit comprising the following component parts is inserted into the inner casing 12'. Rings 81 and 82 having an outer diameters which are a little smaller than the inner diameter of the inner casing 12; a partitioning plate 16' spans the rings 81 and 82 horizontally; the upper heater 57 and the lower heater 62 are installed on the partitioning plate 16'; and shelves 83 and 84, namely, L-shaped fittings which span the rings 81 and 82 are disposed at a position intermediate between the upper heater 57 and the lower heater 62. A food-placing base can be composed by placing a wire rack between the shelves 83 and 84. Thereafter, the ring 82 is fixed to the inner casing 12' by means of soldering or other fixing means. A pair of hinge fittings 42' is fixed to a lower portion of the ring 82. A semicircular door unit 55' has second hinge fitting 47', which engage the hinge fittings 42', installed at the lower portion thereof and is mounted on an opening portion of a space disposed below the partitioning plate 16' of the inner casing 12'. The operation section 37' is installed on an opening portion of a space disposed above the partitioning plate 16'. A piston-shaped oil damper 85 is installed on the second hinge fitting 47' at a rear lower portion thereof.

The functions of the component parts of the oven according to the embodiment shown in FIG. 8 are basically the same as those of the component parts of the oven according to the embodiment shown in FIG. 1 although not all of the same component parts as those of the oven of FIG. 1 are provided in the oven of FIG. 8.

The advantage of the oven according to the embodiment shown in FIG. 8 is that the double wall container can be easily formed. A stainless steel plate as thin as approximately 0.5 mm used in a stainless steel vacuum bottle commercially available is not broken by the pressure of outside air because the vacuum bottle is cylindrical, whereas in the case of the oven of FIG. 1 which is not cylindrical but rather has flat walls, it is necessary to provide a reinforcing construction such as a thick stainless steel plate between the outer casing and the inner casing of the oven.

The idea common to the embodiments shown in FIGS. 1 and 8 is that the interior of the container 11 or 11' (having the opening portion almost the same as the inner size of the container 11 or 11') is divided into two regions (spaces) by the partitioning plate 16 or 16' made of metal which has a surface perpendicular to the opening portion and can be inserted into the container 11 or 11' from the opening portion. One of the spaces serving as the heating chamber is provided with the door for closing the space, and the other space serving as the mechanical chamber 63 is provided with the operation section disposed at the opening portion thereof. Accordingly, the heating chamber has a preferable heat insulating effect and thus the container accommodating the heating chamber has a very high heat efficiency. Thus, the oven can be used to bake food and heat food by using microwaves.

Although the double wall vacuum container has been described, a metal container with a single wall can be constituted of the component parts shown in FIGS. 1 and 8. In this case, there is no possibility that the container will be broken by the pressure of outside air because no vacuum is formed in the container. Therefore, no specific reinforcing construction is required for the container, shown in FIG. 1, the walls of which are flat. The metal container serves as the wall of the heating chamber and the outer casing, the oven according to the present invention has a simpler construction than the conventional oven. In addition, as apparent from FIG. 1, the partitioning plate 16 has an opening portion in the upper surface, right side surface, and rear surface thereof. Thus, electrical parts can be freely installed in the container and the assembled unit 15 can be easily inserted thereinto and fixed thereto unlike the conventional oven. In this manner, the manufacture of the microwave oven is completed.

Figure 9:
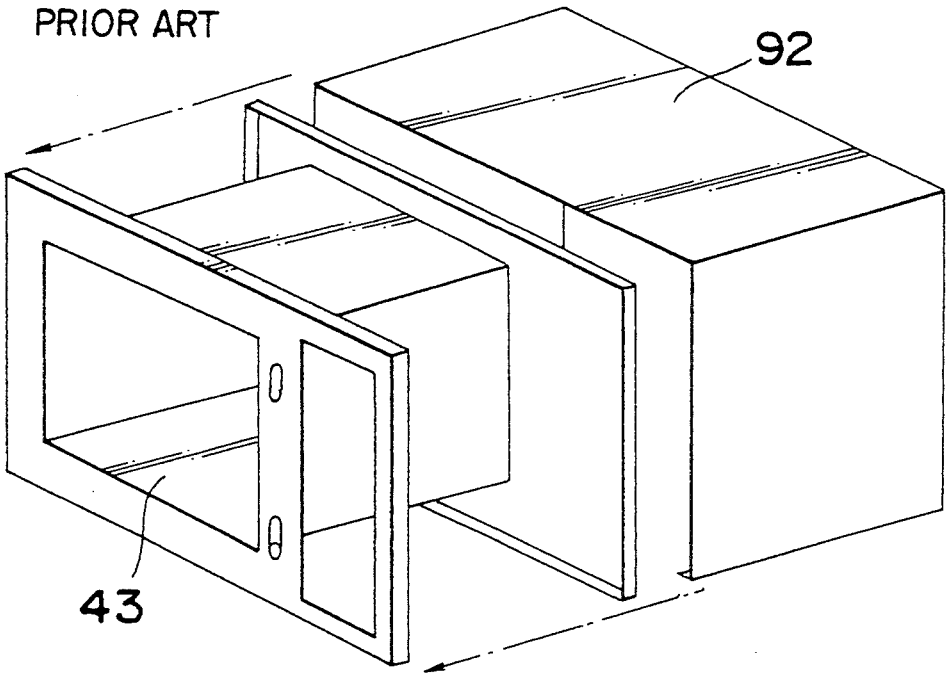
Fig. 9 PRIOR ART
FIG. 9 is an exploded perspective view showing a conventional microwave oven.
Figure 10:
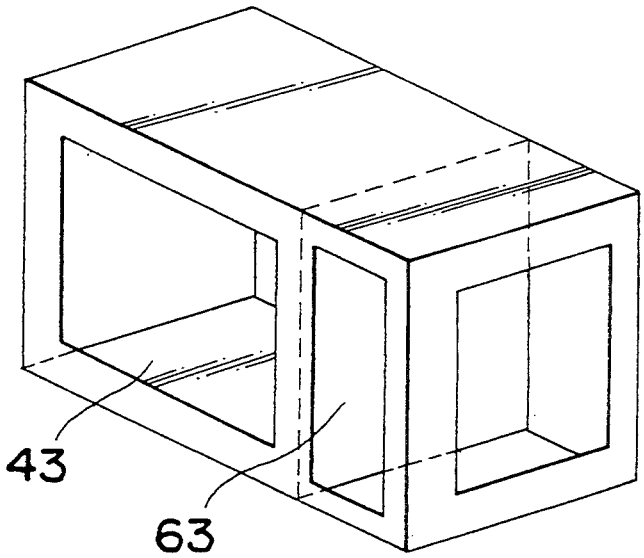
Fig. 10 PRIOR ART
FIG. 10 is a perspective view showing a conventional microwave oven.

In the embodiments shown in FIGS. 1 and 8, the heaters 57 and 62 are installed or 11' the container 11 in such that they extend through the partitioning plate 16, or 16' the heating portions thereof are mounted in the heating chamber 43, and the terminals thereof are mounted in the mechanical chamber 63. It is easy to adopt system in which hot air is forcibly circulated, i.e., a heater is disposed in the mechanical chamber 63 to forcibly feed hot air into the heating chamber 43 by means of a fan motor. Instead of installing the entire magnetron in the mechanical chamber 63 it is also easy for those skilled in the art to form a small opening in the partitioning plate so that the antenna of the magnetron can be disposed in the heating chamber with the antenna penetrating through the small opening, while other portions of the magnetron are disposed in the mechanical chamber 63. Compared with the constructions of the conventional ovens as shown in FIGS. 9 and 10, a heating source can be easily fixed to the container by installing it on the partitioning plate so as to supply heat to the heating chamber.

After the food-placing means comprising the shelves 83 and 84 and the turntable 59 is directly or indirectly fixed to the partitioning plate 16 are 16' as shown in FIG. 8, the food-placing means is inserted into the container 11 or 11'. Therefore, the food-placing means can be easily installed in the container 11 or 11' compared with the conventional construction as shown in FIGS. 9 and 10. In the conventional construction as shown in FIGS. 9 and 10, it is not easy to insert the heating source, namely, the heater or the food-placing means into the small heating chamber through a small opening, whereas in the oven according to the present invention, the heating source can be installed easily on the partitioning plate 16 so as to be inserted into the container 11 from the wide space formed on the partitioning plate at the upper, left and right side, and rear surfaces thereof.

Figure 11:
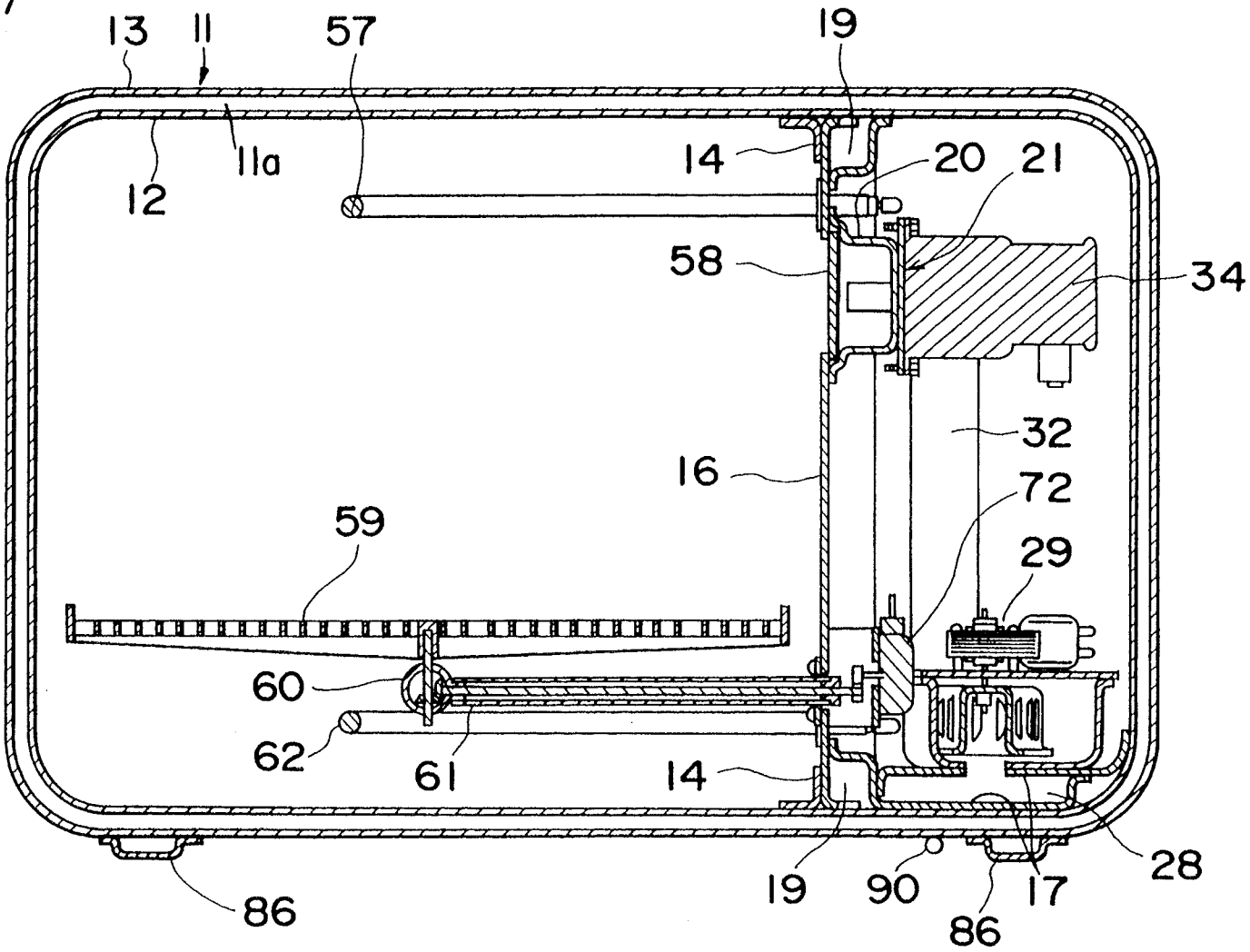
FIG. 11 is a sectional view showing the assembled state of the oven having a function of heating food by high-frequency wave according to the embodiment of FIG. 1.

FIG. 11 shows the essential parts of the embodiment of the present invention in the assembled state thereof in a cross-section seeing backwards from a vertical cross-section passing through the center of turntable 59 and extending to the right and left. In FIG. 11, the fan motor is cut off at a portion of the front side disposed slightly away from center of the motor but not at the center, and it can be seen from the cross-section that the fan is a Silocco fan made of aluminum and having a lower portion coupled to the suction passage 28 through through opening. Also, the lower end of dash-board at the left side is in contact with the L-shaped metal fitting 14, the right side of the bottom plate 17 is bent upwardly to contact with the lower end of the inner casing 12 at the side plane, and the partitioning plate 16 and the bottom plate 17 within the inner casing 12 at the left and right sides are positioned between the metal fitting 14 and inner casing 12. The driving shaft 71 extends through the partitioning plate 16 and is coupled to the motor 72 through gears.

In the oven according to the present invention, by means of Hall elements formed on the front plate in a direction corresponding to the polarity of the magnet fixed to the door of the container, information indicating that the door has been closed can be easily converted into an electric signal, whereas in the conventional oven, a switch and a key-type movable strip which closes a contact of the switch are used. Therefore, the oven according to the present invention is reliable and can be manufactured at a low cost. In addition, even if a magnet is moved near the Hall elements with the door opened, malfunction does not occur because the multi-pole magnet 53 is used.

As described above, the present invention utilizes a double wall metal vacuum container such as those widely used as vacuum bottles which are known for their preferable heat insulating performance. Thus, the oven has a high heat efficiency and the heating chamber has a high volumetric ratio. It seems that it is easy to adopt the structure of the vacuum bottle in the heating chamber of the oven. But it is impossible to replace the heating chamber of the conventional oven with the double wall vacuum container: It is necessary to form a plurality of through-holes in the wall of the double wall vacuum container because a heating source such as a heater is required to penetrate through the wall of the heating chamber. When the air temperature in the heating chamber becomes high, the inner casing of the double wall vacuum container expands, whereas the outer casing expands to a much smaller extent than the inner casing. As a result, the position of the inner casing is changed relative to the outer casing, and a great thermal stress is applied to the through-holes disposed between the inner casing and the outer casing. Consequently, fatigue occurs in the metal and thus the metal becomes cracked and finally, the vacuum cannot be maintained. In order to solve this problem, according to the present invention, through-holes are not formed in the wall of the double wall vacuum container, but are rather formed in the partitioning wall which divides the space of the container into two spaces, namely, the heating chamber and the mechanical chamber.

Further, a microwave oven, according to the present invention, comprising a metal container with a single wall can be manufactured at a low cost and with a high efficiency.

In addition, an oven can be manufactured at a low cost and with a high efficiency by adopting the method of the present invention.

Although the present invention has been fully described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims unless they depart therefrom.

What is claimed is:

1. A high-frequency wave oven comprising:

a metal container having a double wall construction comprising an inner casing and an outer casing with a vacuum space formed between said inner casing and said outer casing, said metal container having a rear side and an open front side, said metal container defining therewithin a container chamber;

a position regulating member mounted in said container chamber;

a metallic partitioning plate removably mounted in said metal container at a position determined by said position regulating member, said partitioning plate dividing said container chamber into a heating chamber and a mechanical chamber;

a door openably mounted to said open front side of said metal container;

a heater mounted in said container chamber; and a high frequency wave heating source mounted in said mechanical chamber for supplying high frequency waves through said partitioning plate and into said heating chamber.

2. A high-frequency wave oven as recited in claim 1, further comprising a slit type choke mounted about at least a portion of a periphery of said metallic partitioning plate.

3. A high-frequency wave oven as recited in claim 1, wherein said high frequency wave heating source comprises a magnetron.

4. A high-frequency wave oven as recited in claim 1, wherein an opening is formed through said partitioning plate; and said high frequency wave heating source is operable to supply said high frequency waves through said partitioning plate via said opening formed therethrough.

5. A high-frequency wave oven as recited in claim 4, wherein said high frequency wave heating source is secured to said partitioning plate, such that said high frequency wave heating source is removable from said container chamber with said partitioning plate.

6. A high-frequency wave oven as recited in claim 1, wherein said high frequency wave heating source is secured to said partitioning plate, such that said high frequency wave heating source is removable from said container chamber with said partitioning plate.

7. A high-frequency wave oven as recited in claim 6, wherein a turntable is provided in said heating chamber and is mounted to said partitioning plate.

8. A high-frequency wave oven as recited in claim 1, wherein a turntable is provided in said heating chamber and is mounted to said partitioning plate.

9. A high-frequency wave oven as recited in claim 1, wherein an operation section is mounted at said open front side of said metal container adjacent said mechanical chamber;

suction openings are formed in a lower portion of said operation section; and discharge openings are formed in an upper portion of said operation section.

10. A high-frequency wave oven comprising:

a metal container having a rear side and an open front side, said metal container defining therewithin a container chamber;

a position regulating member mounted in said container chamber;

a metallic partitioning plate removably mounted in said metal container at a position determined by said position regulating member, said partitioning plate dividing said container chamber into a heating chamber and a mechanical chamber;

a door openably mounted to said open front side of said metal container;

a high frequency wave heating source mounted in said container chamber; and a plurality of electrical components mounted in said mechanical chamber and fastened to said partitioning plate, such that said electrical components are removable from said container chamber with said partitioning plate.

11. A high-frequency wave oven as recited in claim 10, further comprising a choke type microwave leakage prevention means, mounted about at least a portion of a periphery of said metallic partitioning plate, for preventing leakage between said heating chamber and said mechanical chamber.

12. A high-frequency wave oven as recited in claim 10, wherein said high frequency wave heating source comprises a magnetron.

13. A high-frequency wave oven as recited in claim 10, wherein an opening is formed through said partitioning plate; and said high frequency wave heating source is operable to supply said high frequency waves through said partitioning plate via said opening formed therethrough.

14. A high-frequency wave oven as recited in claims 13, wherein said high frequency wave heating source is secured to said partitioning plate, such that said high frequency wave heating source is removable from said container chamber with said partitioning plate.

15. A high-frequency wave oven as recited in claim 10, wherein said high frequency wave heating source is secured to said partitioning plate, such that said high frequency wave heating source is removable from said container chamber with said partitioning plate.

16. A high-frequency wave oven as recited in claim 10, further comprising a multipolar magnet mounted to said door, said multipolar magnet having a first magnet portion polarized in a first direction and a second magnet portion polarized in a second direction opposite said first direction; and a pair of detection members, responsive to polarity of said first and second magnet portions, respectively, for detecting when said door is in the closed position, said detection members being aligned with said first and second magnet portions, respectively, when said door is in the closed position.

17. A high-frequency wave oven as recited in claim 16, wherein said pair of detection members comprises a pair of hall members.

18. A high-frequency wave oven comprising:

a metal container having a double wall construction comprising an inner casing and an outer casing with a vacuum space formed between said inner casing and said outer casing, said metal container having a rear side and an open front side, said metal container defining therewithin a container chamber;

a metallic partitioning plate removably mounted in said metal container, said partitioning plate dividing said container chamber into a heating chamber and a mechanical chamber;

a door mounted to said open front side of said metal container and openably closing a front side of said heating chamber;

a high frequency wave heating source mounted in said mechanical chamber and fastened to said partitioning plate; and a position regulating means mounted in said container chamber for allowing said partitioning plate to be removably slidably inserted through said open front side of said metal container and for positioning said partitioning plate at a predetermined position as said partitioning plate is inserted into said container chamber through said open front side of said metal container.

19. A high-frequency wave oven as recited in claim 18, further comprising a heater having an exothermic portion and being mounted on said partitioning plate such that said exothermic portion is positioned in said heating chamber.

20. A high-frequency wave oven as recited in claim 19, wherein said heater further includes a means, disposed in said mechanical chamber, for providing heat to said exothermic portion.

21. A high-frequency wave oven as recited in claim 18, wherein said position regulating means comprises a pair of elongated flanges mounted to top and bottom walls of said container chamber, respectively, said elongated flanges being L-shaped in cross section, and said elongated flanges extending in a front to rear direction of said metal container.

22. A high-frequency wave oven as recited in claim 18, wherein said metal container is approximately cylindrical; and said position regulating means comprises a pair of spaced apart circular rings, said partitioning plate being fixed to said rings.

23. A method of assembling an oven, comprising:

providing a metal container having a rear side and an open front side, said metal container defining therewithin a container chamber;

providing a metal partitioning plate;

mounting to said metal partitioning plate a heating source and other electrical components;

mounting a position regulating member to one of said metal container and said metal partitioning plate;

after said heating source and said other electrical components have been mounted to said partitioning plate, inserting said partitioning plate into said container chamber through said open front side of said metal container while said position regulating member causes said partitioning plate to be positioned at a predetermined position, such that said container chamber is divided by said partitioning plate into a heating chamber and a mechanical chamber.

24. A method as recited in claim 23, further comprising prior to inserting said partitioning plate into said container chamber, mounting to said partitioning plate a turntable comprising a plurality of metal elements which are spaced apart at regular intervals, have upper surfaces flush with one another and have rectangular cross sections.

* * * * *